United States Patent [19]

Guggemos

[11] Patent Number: 4,998,189

[45] Date of Patent: Mar. 5, 1991

[54] COLLAPSIBLE REFLECTOR UNIT FOR DISPLAY STRUCTURES

[76] Inventor: Giles Guggemos, 1471 Scheffer Ave., St. Paul, Minn. 55116

[21] Appl. No.: 347,478

[22] Filed: May 4, 1989

[51] Int. Cl.[5] ..... F21V 17/02

[52] U.S. Cl. ..... 362/278; 362/352; 362/260; 362/320; 40/571

[58] Field of Search ..... 362/16, 18, 217, 319, 362/320, 260, 303, 277, 278, 347, 352, 358, 361, 226, 457, 812, 297, 300, 310; 40/571

[56] References Cited

U.S. PATENT DOCUMENTS

| | | | |
|---|---|---|---|
| 711,867 | 10/1902 | Kemp | 40/564 |
| 922,958 | 5/1909 | Ryan | 40/571 |
| 1,059,371 | 4/1913 | Kelley | 40/571 |
| 1,488,314 | 3/1924 | Carraine | 40/571 |
| 1,725,936 | 8/1929 | Rogovin | 362/352 |
| 2,205,860 | 6/1940 | Olds | 362/320 |
| 3,939,340 | 2/1976 | Gozzano et al. | 362/320 |
| 3,975,850 | 8/1976 | Giaume | 40/125 H |
| 4,325,197 | 4/1982 | Achten et al. | 40/610 |
| 4,428,030 | 1/1984 | Baliozian | 362/18 |
| 4,446,506 | 5/1984 | Larson | 362/17 |
| 4,471,548 | 9/1984 | Goudie | 40/610 |
| 4,524,405 | 6/1985 | Heard | 362/320 |
| 4,757,425 | 7/1988 | Weltz | 362/18 |

*Primary Examiner*—Stephen F. Husar
*Assistant Examiner*—D. M. Cox
*Attorney, Agent, or Firm*—Peterson, Wicks, Nemer & Kamrath

[57] ABSTRACT

A collapsible reflector unit (70) is disclosed in its preferred form for use in quick-erect portable display structures particularly adapted for temporary tradeshow booths. Unit (70) generally includes a reflector enclosure (74) formed of vinyl coated, fire retardant, flexible fabric attached to the display structure frame (9) around its periphery by a two-part fastening tape (124). The reflector enclosure (74) is supported in a tent-like manner away from the frame (9) by a support frame (72) including flexible rods (78, 80) removably anchored to the frame (9) and extending arcuately from the frame (9). The central segments (84) of the rods (78, 80) are held rearwardly of the frame (9) by interposing rods (92) therebetween, with the rods (92) having extensions (98, 100) extending contiguously therefrom and having their free ends removably anchored to the frame (9) intermediate the anchor locations of the flexible rods (78, 80). A light system (76) is removably attached to the rods (92) by clips (104). The light system (76) includes diffuser plates (118) which may be removably attached to flourescent bulbs (114) by clips (120, 122), with the bulbs (114) in turn removably attached to an electric box (106) by sockets (112) and clips (116). In the most preferred form, the flexible rods (78, 80) are formed by segments (82, 84, 86) removably attached together by fittings (88, 90). The fittings (94) between the rods (92) and their extensions (98, 100) include a bore (96) for slideably receiving the flexible rods (78, 80) for attaching them to rods (82) and their extensions (98, 100).

19 Claims, 2 Drawing Sheets

COLLAPSIBLE REFLECTOR UNIT FOR DISPLAY STRUCTURES

BACKGROUND

The present invention generally relates to collapsible reflector units, particularly to collapsible reflector units for display structures, and specifically to collapsible reflector units for portable display structures particularly adapted for use in temporary tradeshow booths.

As set forth in U.S. Pat. No. 4,325,197, tradeshows provide an excellent opportunity to relatively inexpensively contact a large group of potentially interested persons. Portable display structures are often utilized as an easily erected backwall for a tradeshow booth to provide an aesthetic, eye-catching backdrop for getting the attention of such potentially interested persons.

A need has existed in the use of such display structures to illuminate and preferably backlight the murals of such display structures. However, prior to the present invention, existing devices have not been able to effectively accomplish this need while still meeting the needs of portability and ease of assembly and dismantling required to be practical for use in the tradeshow business.

SUMMARY

The present invention solves these needs and other problems in the field of display structures particularly adapted for the tradeshow business by providing, in the most preferred form, a collapsible reflector unit for use in backlighting a mural in the frame of the display structure. Specifically, in the preferred form, the periphery of a reflector enclosure formed of material which can be folded up for portability is secured to the display structure frame. A support frame is provided for supporting the reflector enclosure away from the display structure frame and includes a flexible rod having its free ends removably anchored to the display structure frame at anchor locations spaced less than the length of the flexible rod with the flexible rod extending generally arcuately between the anchor locations. The flexible rod its held adjacent is center rearwardly of the display structure frame. A light system is attached to the support frame generally rearwardly of the display structure frame and generally rearwardly of the display structure frame and within the reflector enclosure.

It is thus an object of the present invention to provide a novel collapsible reflector unit for display structures.

It is further an object of the present invention to provide such a novel collapsible reflector unit for use with portable display structures.

It is further an object of the present invention to provide such a novel collapsible reflector unit for use with portable display structures particularly adapted for use in temporary tradeshow booths.

It is further an object of the present invention to provide such a novel collapsible reflector unit for backlighting murals.

It is further an object of the present invention to provide such a novel collapsible reflector unit which is portable and easily transported in luggage size containers.

It is further an object of the present invention to provide such a novel collapsible reflector unit which is easily assembled and disassembled and preferably without the use of tools.

It is further an object of the present invention to provide such a novel collapsible reflector unit which is relatively shallow in relation to the size of the illuminated mural.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 2:
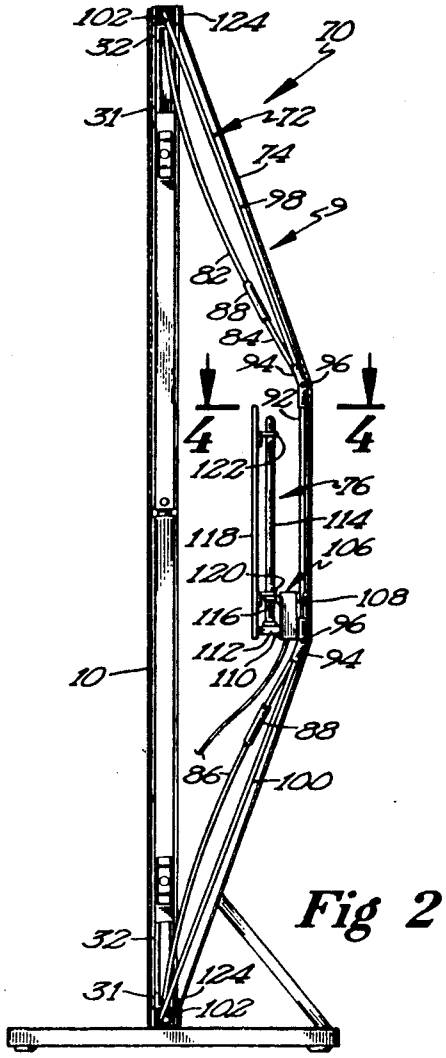
FIG. 2 shows a cross sectional view of the collapsible reflector unit of FIG. 1 according to section line 2—2 of FIG. 1.
Figure 1:
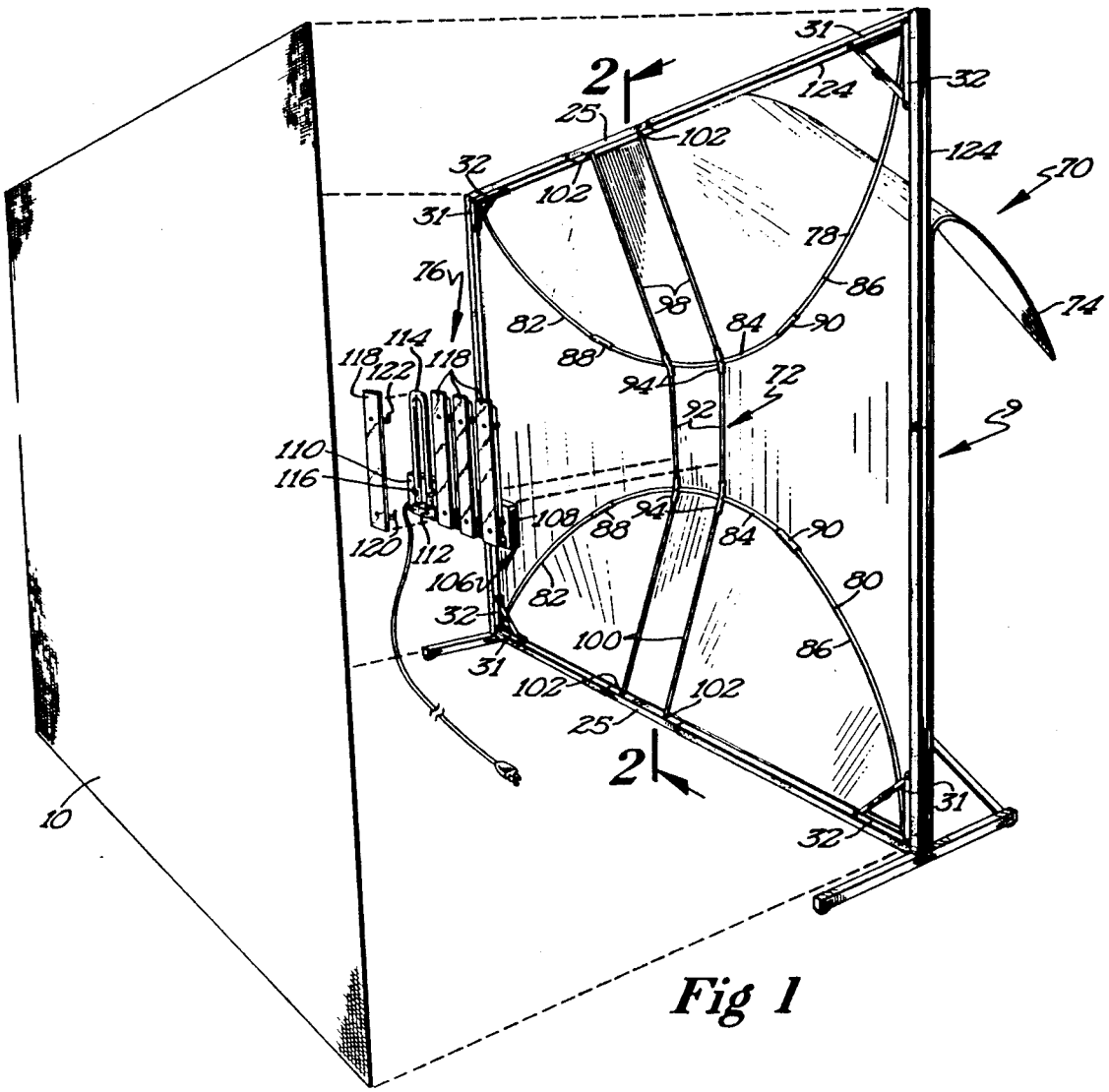
FIG. 1 shows an exploded, perspective view of a collapsible reflector unit attached to the rear of a display structure according to the preferred teachings of the present invention.
Figure 3:
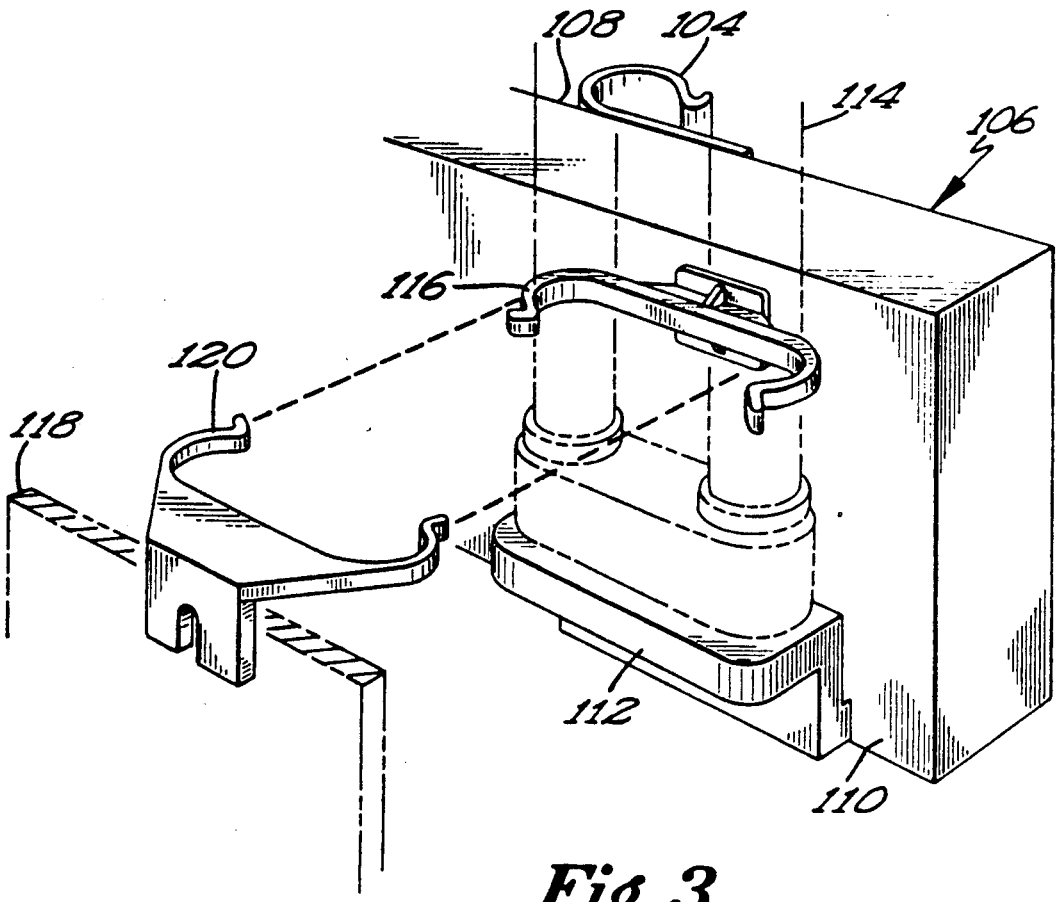
FIG. 3 shows an exploded, perspective view of a light system of the collapsible reflector unit of FIG. 1.
Figure 4:
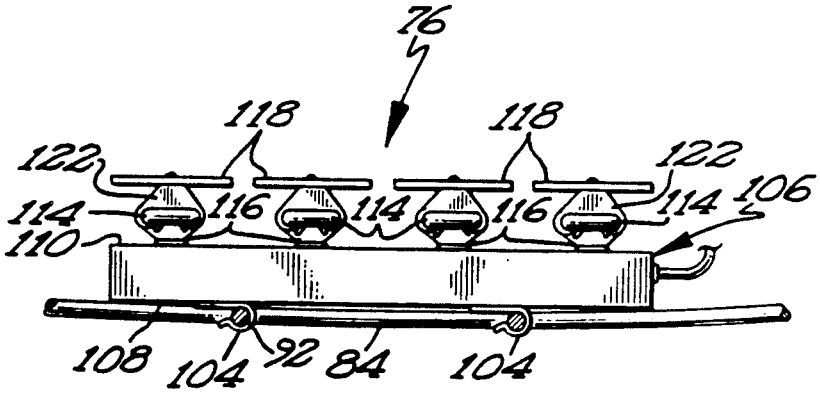
FIG. 4 shows a partial, cross sectional view of the collapsible reflector unit of FIG. 1 according to section line 4—4 of FIG. 2.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "upper", "lower", "vertical", "horizontal", "rearward", "ends", "corners", and similar terms are used herein, it should be understood that these terms have reference only to the structure shown in the drawings as it would appear to a person viewing the drawings and are utilized only to facilitate describing the invention.

DESCRIPTION

A collapsible reflector unit according to the preferred teachings of the present invention is shown for attachment to the back of a display structure in the drawings and is generally designated 70. The display structure can be of a variety of forms having an open face vertical frame 9 upon which is suspension mounted a mural 10. Mural 10 can similarly be of many forms and types including photographic, computer painted, hand painted, silk screened or the like. The most preferred embodiment of unit 70 of the present invention has been shown and will be disclosed for attachment to a display structure of the type shown and described in U.S. Pat. No. 4,325,197. For purposes of explanation of the basic teachings of the present invention, the same numerals designate the same or similar parts in the present Figures and the Figures of U.S. Pat. No. 4,325,197. The description of the common numerals and the display structure may be found herein and in U.S. Pat. No.

4,325,197, which is hereby incorporated herein by reference.

Unit 70 generally includes a collapsible support frame 72, a removable reflector enclosure 74, and a light system 76 removably attached to frame 72. Frame 72 supports reflector enclosure 74 away from frame 9 in a tent-like manner and generally includes first and second flexible rods 78 and 80 which have lengths greater than the width of frame 9. The free ends of rod 78 are removably anchored to the upper corners of frame 9 and the free ends of rods 80 are removably anchored to the lower corners of frame 9. Thus, the anchor locations of the free ends of rods 78 and 80 are in a parallel and spaced relation. In the most preferred form, the diameters of rods 78 and 80 are less than the spacing between the upstanding legs of channel members 31 and 32 of frame 9. In the most preferred form, the free ends of rods 78 and 80 are received in channel members 31 and 32 which are arranged horizontally at the respective corners of frame 9. It can then be appreciated that due to the greater length of rods 78 and 80 than the spacing between the anchor locations of their free ends, in the most preferred form the width of frame 9, and the flexibility of rods 78 and 80, rods 78 and 80 will extend generally arcuately between the corners of frame 9.

For ease of transport in a collapsed condition, rods 78 and 80 are formed by a plurality of segments which may be collapsed to a length which is a fraction of the total length of rods 78 and 80. In the most preferred form, rods 78 and 80 are formed of independent segments 82, 84 and 86 which may be removably connected or disconnected together by fittings 88 and 90 which slideably receive the ends of segments 82, 84 and 86. Rods 78 and 80 may be formed of any suitable, preferably lightweight material such as fiberglass.

Frame 72 further includes suitable provisions for holding the central portions of rods 78 and 80 rearward of frame 9 and in the preferred form segment 84 rearward of frame 9. In the most preferred form, generally vertical rods 92 are provided interposed between segments 84 of rods 78 and 80. Specifically, fittings 94 are slideably received on the free ends of vertical rods 92 and include a bore 96 of a size and shape for receiving segments 84 of rods 78 and 80. The length of rods 92 and particularly the spacing between bores 96 of fittings 94 is greater than the spacing between the central portions, in the most preferred form segments 84, of rods 78 and 80 when extending between the corners of frame 9 and generally planar with frame 9. Thus, due to the anchoring of the free ends of rods 78 and 80, rods 78 and 80 will form a dome like structure extending rearwardly when their central portions are held in a spaced condition by rods 92.

In the most preferred form, rods 92 further include first and second extensions 98 and 100 having their first ends generally contiguously connected to rods 92 by fittings 94. The second, free ends of extensions 98 and 100 are removably anchored to the horizontal, upper and lower members of frame 9 and in the most preferred form to extension members 25 thereof. Specifically, the free ends of extensions 98 are removably)y anchored at anchor locations intermediate the anchor locations of the free ends of rod 78 and the free ends of extensions 100 are removably anchored at anchor locations intermediate the anchor locations of the free ends of rod 80. The anchor locations of extensions 98 and of extensions 100, respectively, are in a spaced and parallel relation. In the most preferred form, the free ends of extensions 98 and 100 are removably anchored by their insertion into bores 102 drilled into extension members 25. Extensions 98 and 100 and preferably rods 92 are of a flexible nature and preferably of the same diameter and material as rods 78 and 80.

In the most preferred form, fittings 94 have an angular configuration such that rods 92 extend generally vertically between rods 78 and 80 and generally parallel to frame 9 and mural 10 and that extensions 98 and 100 extend generally straight and/or slightly arcuately between frame 9 and rods 78 and 80, with extensions 98 and 100 having a slightly longer length than the spacing of fittings 94 from frame 9 with extensions 98 and 100 removed. Bores 96 are drilled adjacent the outside surface of fittings 94 generally at the point of the angular configuration thereof for slideably receiving segments 84 of rods 78 and 80.

It can then be appreciated that rod 92 and extensions 98 and 100 form an elongated bar having a length and first and second free ends which are anchored at locations which are spaced less than the length of the elongated bar to thus extend arcuately therebetween and which are generally perpendicular to and spaced from the anchor locations of rods 78 and 80. Thus, the elongated bar holds the central portions of rods 78 and 80 rearwardly of frame 9. It can be appreciated that any desired number of rods 92 with or without extensions 98 and 100 may be provided as desired, with two sets as shown in the preferred form being illustrative.

Light system 76 is removably attached to frame 72 generally rearwardly of frame 9 and within reflector enclosure 74 by any suitable means such as by C-clips 104 which are removably secured to rods 92 in the most preferred form. It can then be appreciated that light system 76 can be of a variety of forms and types and in the most preferred form is fluorescent. Selection of the particular light system 76 utilized depends upon several factors including its compactness, the ability to be easily collapsed and transported with frame 72 and enclosure 74, the ability to vary the number and intensity of light fixtures and sources, and like factors.

In the most preferred form, light system 76 generally includes an elongated electrical box 106 having a rectangular cross section and including first and second faces 108 and 110, respectively. C-clips 104 are adhesively secured to face 108 of box 106, with C-clips 104 being vertically arranged to snap over rods 92 of frame 72. At least one electrical socket 112 extends from face 110 and electrically receives a generally U-shaped fluorescent bulb 114 which extends generally parallel to face 110. A clip 116 is secured to face 110 of box 106, such as by a tab which snaps into an aperture formed in box 106, for removable attachment to bulb 114. A diffuser plate 118 is held adjacent bulb 114 and intermediate bulb 114 and mural 10 by clips 120 and 122. In the most preferred form, clips 120 and 122 are secured to diffuser plate 118 such as by screws and are removably attached to bulb 114. Clip 120 rests on top of clip 116 for supporting diffuser plate 118 relative to bulb 114. It can then be appreciated that the number of bulbs 114 can be varied for connection to electrical box 106 depending upon the amount of light desired for the particular mural 10 being displayed in frame 9.

It can then be appreciated that the preferred form of light system 76 is advantageous according to the teachings of the present invention. For example, light system 76 may be easily collapsed for transport by unsnapping clips 120 and 122 from bulb 114, by removing bulb 114 from clip 116 and socket 112, and by removing clips 104 from rods 92. Thus, light system 76 can be compactly packed as individual components when it is desired to transport unit 70 and conversely can be easily and rapidly assembled at the tradeshow location without the use of tools. Further, light system 76 is very compact which allows maximization of spacing from mural 10 while minimizing the depth of unit 70. Similarly, diffuser plates 118 prevent hot spots from developing on mural 10 in addition to helping evenly distribute the light to mural 10.

Reflector enclosure 74 according to the preferred teachings of the present invention is secured to frame 9 and is supported by frame 72 and can be easily assembled and disassembled, collapsed, and transported with frame 72. Enclosure 74 may be formed of a variety of materials that can be folded up for portability and in the most preferred form, is formed of flexible fabric and specifically is formed of fire retardant, black out fabric which is vinyl coated with a reflective white coating which when supported away from frame 9 by frame 72 provides even, controlled, diffused light from light system 76 to mural 10 of frame 9. Reflector enclosure 74 is of a size larger than frame 9 and is suspended on the back face of frame 9 opposite mural 10 and in a taut condition. In the most preferred form, reflector enclosure 74 is attached to frame 9 in the similar manner as mural 10 is attached to frame 9. For example, one part of a two-part fastening tape 124 such as the type sold under the trademarks VELCRO and SCOTCHMATE may be secured to the periphery of reflector enclosure 74 such as by sewing, while the other part of the two-part fastening tape may be secured at corresponding locations on frame 9 such as by adhesive.

Due to the flexible nature of reflector enclosure 74 in the most preferred form, enclosure 74 may be fastened to frame 9 in a taut manner over frame 72 for maintaining the free ends of rods 78 and 80 and the extensions 98 and 100 of frame 72 in their anchor locations in frame 9. Enclosure 74 may include loop like structures through which rods 78, 80 and/or 92 and/or extensions 98 and 100 may be removably threaded or inserted through for providing further support to enclosure 74 by frame 72 and/or to hold rods 78 and 80 rearwardly of frame 9.

Now that the basic teachings of the present invention have been explained, subtle features of unit 70 can be set forth and appreciated. Specifically, it can be appreciated that unit 70 is very light weight and portable, can be easily assembled and disassembled without the use of tools, and can be transported in a luggage size case. Further, unit 70 can be provided with a display structure and particularly of the type utilized at tradeshows to provide backlighting of mural 10 thereof. Specifically, unit 70 while being very portable also is able to backlight mural 10 of a very large size, typically in the range of 93 to 96 inches (2.36 to 2.44 meters) high and 87 to 122 inches (2.21 to 3.10 meters) wide. Furthermore, unit 70 while in use assembled to frame 9 is relatively shallow in relation to the size of the illuminated mural 10 which is important for space limitations at booths at tradeshows. Thus, unit 70 provides an effective and practical method of backlighting murals 10 of display structures particularly adapted for the trade show business.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Collapsible reflector unit for use in backlighting a mural mounted to a display structure frame comprising, in combination: a reflector enclosure of a size larger than the display structure frame, with the reflector enclosure being formed of material which can be folded up for portability, with the periphery of the reflector enclosure being secured to the display structure frame; means for supporting the reflector enclosure away from the display structure frame and the mural mounted thereto comprising, in combination: at least a first flexible rod having a length, a central portion, and first and second free ends, with the first flexible rod formed of a plurality of segments collapsible for portability to a length which is a fraction of the length of the first flexible rod, with the free ends of the first flexible rod being removably anchored to the display structure frame at anchor locations spaced less than the length of the first flexible rod with the first flexible rod extending generally arcuately between the anchor locations; and means for removably holding the central portion of the first flexible rod rearwardly of the display structure frame and the mural mounted thereto; and a light system attached to the supporting means generally rearwardly of the display structure frame and the mural mounted thereto and within the reflector enclosure for backlighting the mural mounted to the display structure frame.

2. The collapsible reflector unit of claim 1 further comprising, in combination: a second flexible rod having a length, a central portion, and first and second free ends, with the free ends of the second flexible rod being removably anchored to the display structure frame at anchor locations spaced less than the length of the second flexible rod with the second flexible rod extending generally arcuately between the anchor locations, with the anchor locations of the second flexible rod being parallel to but spaced from the anchor locations of the first flexible rod, with the removably holding means including means for removably holding the central portion of the second flexible rod rearwardly of the display structure frame.

3. The collapsible reflector unit of claim 2 wherein the second flexible rod is formed of a plurality of segments collapsible for portability to a length which is a fraction of the length of the second flexible rod.

4. The collapsible reflector unit of claim 3 wherein the segments of the first and second flexible rods are removably received in fittings allowing removable disconnection and connection together.

5. The collapsible reflector unit of claim 4 wherein the removably holding means comprises at least a third rod interposed between the central portions of the first and second flexible rods.

6. The collapsible reflector unit of claim 5 wherein the removably holding means further comprises, in combination: first and second extensions located on opposite ends and extending generally contiguously from the third rod, with the first and second extensions having free ends, with the free end of the first extension removably anchored to the display structure frame at an anchor location intermediate the anchor locations of the first flexible rod, with the free end of the second extension removably anchored to the display structure frame at an anchor location intermediate the anchor locations of the second flexible rod, with the third rod and the first and second extensions extending generally arcuately between the anchor locations.

7. The collapsible reflector unit of claim 6 wherein the first and second extensions are removably received in fittings allowing removable disconnection and connection to the third rod.

8. The collapsible reflector unit of claim 7 wherein the extension fittings have an angular configuration, with the third rod extending generally parallel to the display structure frame.

9. The collapsible reflector unit of claim 7 wherein the first and second flexible rods are slideably received in bores formed in the extension fittings for interposing the third rod between the central portions of the first and second flexible rods.

10. The collapsible reflector unit of claim 6 wherein the removably holding means comprises, in combination: a fourth rod interposed between the central portions of the first and second flexible rods; third and fourth extensions located on opposite ends and extending generally contiguously from the fourth rod, with the third and fourth extensions having free ends, with the free end of the third extension removably anchored to the display structure frame at an anchor location intermediate the anchor locations of the first flexible rod, with the free end of the fourth extension removably anchored to the display structure frame at an anchor location intermediate the anchor locations of the second flexible rod, with the fourth rod and the third and fourth extensions extending generally arcuately between the anchor locations, with the anchor locations of the third and fourth extensions being generally parallel to and spaced from the anchor locations of the first and second extensions.

11. The collapsible reflector unit of claim 2 wherein the removably holding means comprises at least a third rod interposed between the central portions of the first and second flexible rods.

12. Collapsible reflector unit for use in backlighting a mural mounted to a display structure frame comprising, in combination: a reflector enclosure of a size larger than the display structure frame, with the reflector enclosure being formed of material which can be folded up for portability, with the periphery of the reflector enclosure being secured to the display structure frame; means for supporting the reflector enclosure away from the display structure frame and the mural mounted thereto comprising, in combination: at least a first flexible rod having a length, a central portion, and first and second free ends, with the free ends of the first flexible rod being removably anchored to the display structure frame at anchor locations spaced less than the length of the first flexible rod with the first flexible rod extending generally arcuately between the anchor locations; a second flexible rod having a length, a central portion, and first and second free ends, with the free ends of the second flexible rod being removably anchored to the display structure frame at anchor locations spaced less than the length of the second flexible rod with the second flexible rod extending generally arcuately between the anchor locations, with the anchor locations of the second flexible rod being parallel to but spaced from the anchor locations of the first flexible rod; means for removably holding the central portions of the first and second flexible rods rearwardly of the display structure frame and the mural mounted thereto; and a light system attached to the supporting means generally rearwardly of the display structure frame and the mural mounted thereto and within the reflector enclosure for backlighting the mural mounted to the display structure frame; wherein the removably holding means comprises, in combination: at least a third rod interposed between the central portions of the first and second flexible rods; first and second extensions located on opposite ends and extending generally contiguously from the third rod, with the first and second extensions having free ends, with the free end of the first extension removably anchored to the display structure frame at an anchor location intermediate the anchor locations of the first flexible rod, with the free end of the second extension removably anchored to the display structure frame at an anchor location intermediate the anchor locations of the second flexible rod, with the third rod and the first and second extensions extending generally arcuately between the anchor locations.

13. The collapsible reflector unit of claim 12 wherein the reflector enclosure is formed of flexible fabric, with the reflector enclosure including a reflective, white coating which when supported by the supporting means provides even, diffused light from the light system.

14. The collapsible reflector unit of claim 13 wherein the periphery of the reflector enclosure is removably secured to the display structure frame by a two-part fastening tape.

15. The collapsible reflector unit of claim 13 wherein the light system comprises, in combination: a fluorescent bulb; and a diffuser plate adjacent the fluorescent bulb and intermediate the fluorescent bulb and the mural.

16. The collapsible reflector unit of claim 15 wherein the light system further comprises, in combination: an electric box having first and second faces, a first clip secured to the first face of the electric box for removable attachment to the third rod; a socket extending from the second face of the electric box for electrically receiving the fluorescent bulb with the fluorescent bulb extending generally parallel to the second face; a second clip secured to the second face of the electric box and spaced from the socket for removable attachment to the fluorescent bulb; and at least a third clip secured to the diffuser plate for removable attachment to the fluorescent bulb, with the third clip resting on the second clip for supporting the diffuser plate relative to the fluorescent bulb.

17. Collapsible reflector unit for use in backlighting a mural mounted to a display structure frame comprising, in combination: a reflector enclosure of a size larger than the display structure frame, with the reflector enclosure being formed of material which can be folded up for portability, with the periphery of the reflector enclosure being secured to the display structure frame; means for supporting the reflector enclosure away from the display structure frame and the mural mounted thereto comprising, in combination: at least a first flexible rod having a length, a central portion, and first and second free ends, with the free ends of the first flexible rod being removably anchored to the display structure frame at anchor locations spaced less than the length of the first flexible rod with the first flexible rod extending generally arcuately between the anchor locations; means for removably holding the central portion of the first flexible rod rearwardly of the display structure frame and the mural mounted thereto; and a light system attached to the supporting means generally rearwardly of the display structure frame and the mural mounted thereto and within the reflector enclosure for backlighting the mural mounted to the display structure frame; wherein the light system comprises, in combination: a fluorescent bulb; a diffuser plate; an electric box having first and second faces, a first clip secured to the first face of the electric box for removable attachment to the supporting means; a socket extending from the second face of the electric box for electrically receiving the fluorescent bulb with the fluorescent bulb extending generally parallel to the second face; a second clip secured to the second face of the electric box and spaced from the socket for removable attachment to the fluorescent bulb; and at least a third clip secured to the diffuser plate for removable attachment to the fluorescent bulb, with the third clip resting on the second clip for supporting the diffuser plate relative to the fluorescent bulb and intermediate the fluorescent bulb and the mural.

18. Collapsible reflector unit for use in backlighting a mural mounted to a display structure frame comprising, in combination: a reflector enclosure of a size larger than the display structure frame, with the reflector enclosure being formed of material which can be folded up for portability, with the periphery of the reflector enclosure being secured to the display structure frame; means for supporting the reflector enclosure away from the display structure frame and the mural mounted thereto comprising, in combination: at least a first flexible rod having a length, a central portion, and first and second free ends, with the free ends of the first flexible rod being removably anchored to the display structure frame at anchor locations spaced less than the length of the first flexible rod with the first flexible rod extending generally arcuately between the anchor locations; means for removably holding the central portion of the first flexible rod rearwardly of the display structure frame and the mural mounted thereto; and a light system attached to the supporting means generally rearwardly of the display structure frame and the mural mounted thereto and within the reflector enclosure for backlighting the mural mounted to the display structure frame; wherein the removably holding means comprises, in combination: a bar having a length and first and second free ends, with the free ends of the bar being removably anchored to the display structure frame at anchor locations spaced less than the length of the bar with the bar extending generally arcuately between the anchor locations, with the anchor locations of the bar being perpendicular to and spaced from the anchor locations of the first flexible rod, with the central portion of the first flexible rod being secured to the bar intermediate its first and second free ends.

19. The collapsible reflector unit of claim 18 wherein the bar comprises, in combination: a second rod; at least a first extension; a fitting for allowing removable disconnection and contiguous connection of the second rod to the first extension; and a bore formed in the fitting for slideably receiving the first flexible rod.

* * * * *